United States Patent [19]

Womack

[11] 4,108,389

[45] Aug. 22, 1978

[54] DISPENSER FOR A PLURALITY OF ROLLS OF SHEET MATERIAL

[76] Inventor: Rolla J. Womack, P.O. Box 56, Dawson, Ill. 62520

[21] Appl. No.: 848,905

[22] Filed: Nov. 7, 1977

[51] Int. Cl.[2] ..... B65H 19/04

[52] U.S. Cl. ..... 242/55.3; 312/39

[58] Field of Search ..... 242/55.3, 55.2, 55.53; 312/39

[56] References Cited

U.S. PATENT DOCUMENTS

| | | | |
|---|---|---|---|
| 2,592,346 | 4/1952 | Scogin | 242/55.3 |
| 2,605,975 | 8/1952 | Page | 242/55.3 |
| 2,758,800 | 8/1956 | McCants | 242/55.3 |
| 2,794,604 | 6/1957 | Jacomaro | 242/55.3 |
| 3,865,295 | 2/1975 | Okamura | 242/55.3 |

*Primary Examiner*—Edward J. McCarthy

*Attorney, Agent, or Firm*—Grace J. Fishel

[57] ABSTRACT

A cabinet for dispensing paper from paper rolls, such as toilet paper, utilizes two downward-leading pairs of facing flanged channels as tracks in which spindles carrying the paper rolls are engaged. An upper pair of tracks is fixed, while a lower pair of tracks may be pivoted to align the upper and lower tracks for feeding a second roll of paper stored in the upper track to the lower track and into position for dispensing. Previous to pivoting, the upper edge of one channel of the lower track is positioned intermediate the channels of said upper track and supports the second roll of paper. A third roll may be stored in the upper tracks above detent pins, which are inserted into the upper tracks as the second roll is fed into position for dispensing, to prevent the third roll from descending to the lower tracks.

8 Claims, 7 Drawing Figures

DISPENSER FOR A PLURALITY OF ROLLS OF SHEET MATERIAL

BACKGROUND OF THE INVENTION

The present invention relates to dispensing cabinets for dispensing paper from rolls, and particularly to such cabinets which permit storage of additional rolls of toilet tissue for use when the first roll is spent.

In the prior art paper dispensing cabinets which stored additional rolls took various forms. The invention disclosed in U.S. Pat. No. 2,627,382 issued to Barton utilized two nonaligned pairs of fixed opposing tracks in which paper rolls on spindles were engaged. A stored roll was held in position at the lower end of an upper pair of tracks by a closure. Paper was dispensed from a roll held in the lower tracks. Cutouts were provided such that the spindles could be conveyed from the upper tracks to the nonaligned lower tracks. Various means for so conveying the spindles were disclosed.

U.S. Pat. Nos. 2,605,975 to Page, 2,758,800 to McCants, 2,794,604 to Jacomaro, and 2,592,346 to Scogin disclose dispensing cabinets utilizing a single pair of fixed opposing tracks.

In a patent to Jesperson, U.S. Pat. No. 3,770,222, a structure is disclosed in which as the diameter of the roll becomes small, the roll falls to the floor and a roll stored thereabove descends to take its place.

SUMMARY OF THE INVENTION

An object of the present invention is to provide a dispensing cabinet of simple construction for home or institutional use in which one or more fresh rolls of paper may be stored, for easy replacement of a spent roll. It is a further object of the present invention to provide a simply constructed positively operated mechanism for feeding one or more fresh rolls as a spent roll is removed. Other objects will be apparent from the disclosure which follows.

Summarily described, the present dispensing cabinet utilizes a pair of facing double-flanged upper channel tracks fixed to the opposing side walls of the cabinet interior, and a pair of facing double-flanged lower channel tracks mounted pivotably on short pins fixed to the cabinet side walls below the upper channel tracks. Spindles, of sufficient length to fit slidably in the tracks and of such diameter to fit within the cores of the rolls, are provided. A track closure closes the lower end of each lower channel to retain a spindle thereat, providing a dispensing position from which paper may be dispensed from a roll. The lower channel tracks below the pivot pins are angled forward and downward toward the front of the cabinet and openings are provided in their upper flanges adjacent to the closure permitting removal of spend rolls.

The lower channel tracks are normally positioned at such an angle, hereafter referred to as the stop angle, such that the upper end of one flange of each of the lower channel tracks is out of registration with the adjacent end of the upper channel track; thus a fresh roll of paper may be stored in the upper channel tracks on a spindle abutting the intermediate flange. To feed the fresh roll from the upper channel track to the lower channel track, the lower channel track is pivoted to an angle, hereafter referred to as the feed angle, such that the lower end of each upper channel track is adjacent to and in registration with the corresponding upper end of the lower channel track, allowing the fresh roll to descend to dispensing position. A lever joins the lower ends of the lower channel tracks and extends outward through a forward opening of the cabinet to permit manual movement of the lower tracks.

Several simple modifications permit storage of a second fresh roll of paper above the first. In this embodiment the length of the upper tracks is greater than the diameter of a fresh roll of paper. An aperture is provided in the lower end of each of the upper channel tracks spaced upward from the lower channel track a distance greater than the diameter of one of the spindles. Angle detent pins are so fixed to each lower channel track as to be inserted through the apertures into the upper tracks when the lower track is pivoted to the feed angle. This stops the descent of the second fresh roll until the lower tracks are again pivoted out of registration with the upper tracks, causing the detent pins to be withdrawn and permitting the second fresh roll to descend to the position previously occupied by the first fresh roll.

BRIEF DESCRIPTION OF THE DRAWINGS

FIG. 3 shows the position of the rolls and corresponding spindles when the dispensing cabinet has been replenished with paper.

DESCRIPTION OF THE PREFERRED EMBODIMENT

Figure 1:
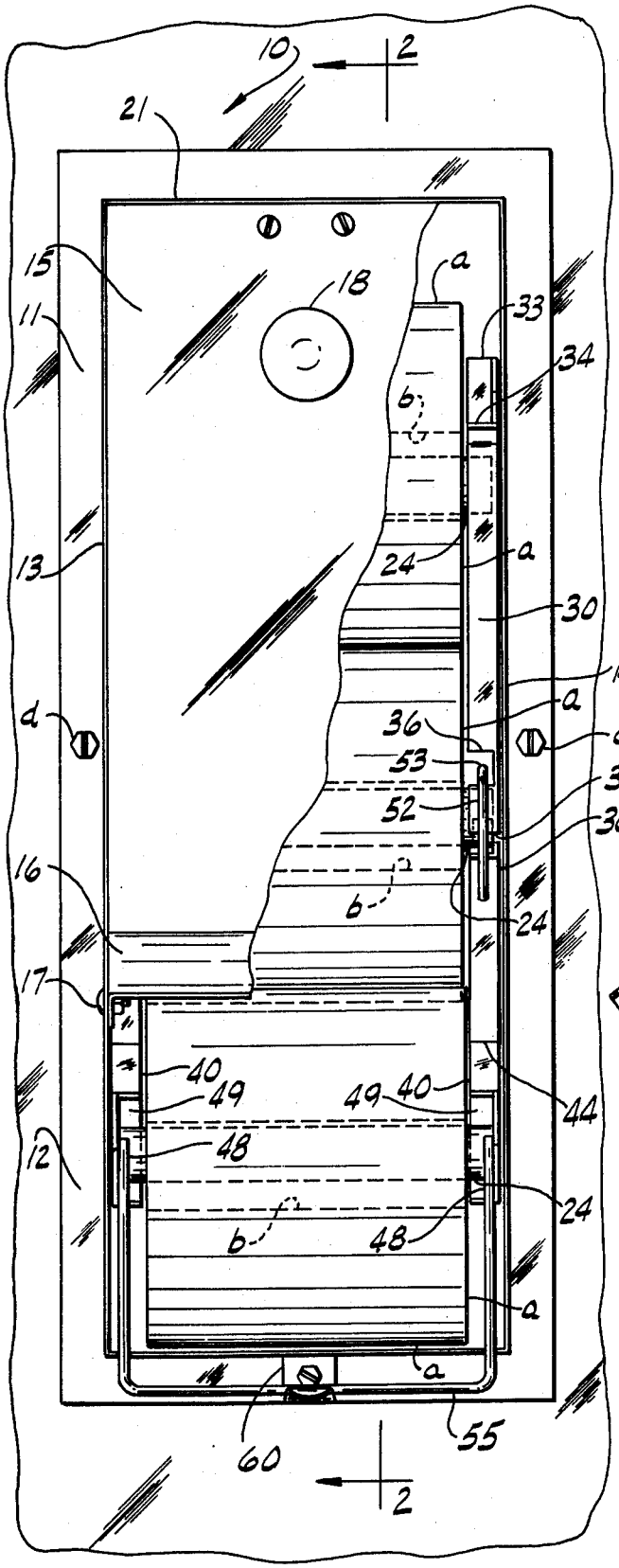
FIG. 1 is a front view of a preferred embodiment of the present invention. The forward door is partially cut away to reveal the interior of the cabinet.
Figure 2:
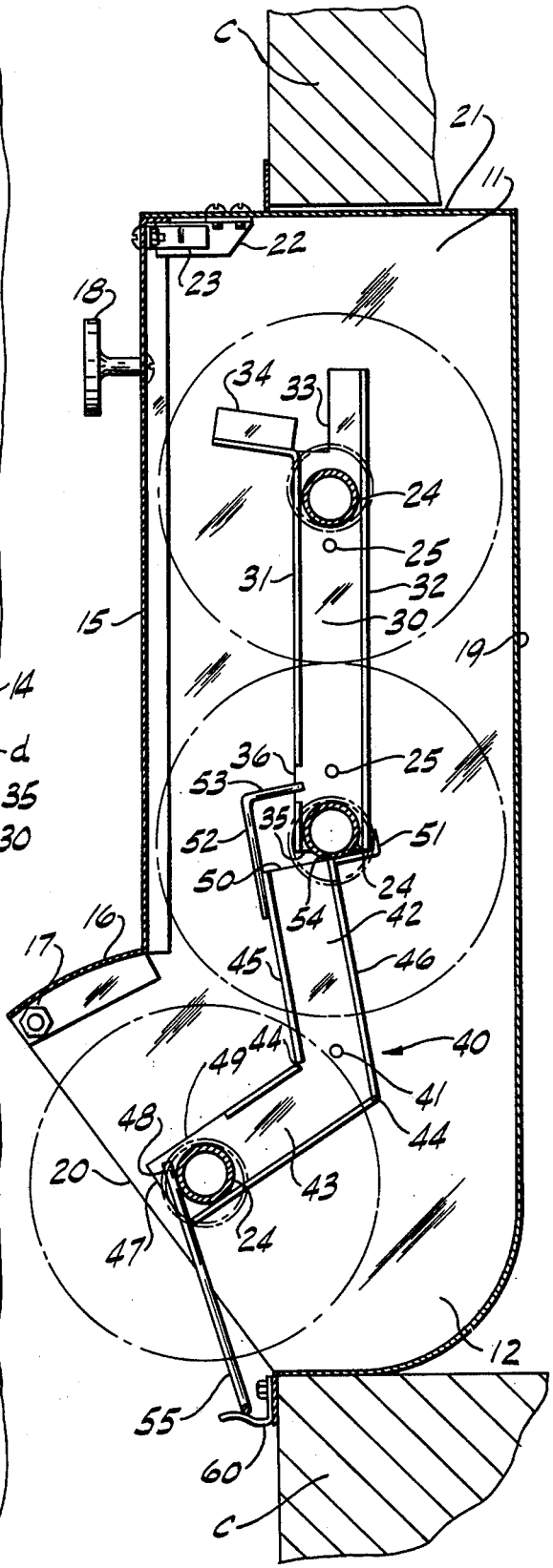
FIG. 2 is a sectional view of the embodiment of FIG. 1 taken along line 2—2 of FIG. 1. Rolls of paper are shown in phantom lines.

A preferred embodiment of the present invention, as shown in FIGS. 1–5 of the accompanying drawings, may be utilized for dispensing paper from rolls of paper *a*, such as toilet tissue, which are rolled on hollow cores *b*. The present invention may be conveniently mounted into a wall *c* with mounting screws *d*.

A dispensing cabinet, generally designated 10, has an upper storage portion 11 and a lower dispensing portion 12. The dispensing cabinet has a left fixed side wall 13 and a right fixed side wall 14 as well as a forward door 15 whose lower door portion 16 projects forward and is mounted by horizontally aligned hinge bolts 17 in forward projections of the side walls 13, 14. The door 15 has a pull knob 18. The dispensing cabinet 10 further has a rear wall 19 whose lower portion extends well below the forward door 15 and curves forward to provide a forward opening 20. The cabinet 10 has a top wall 21 beneath which is mounted a door catch 22 which receives a latching member 23 projecting from the door 15.

A plurality of spindles 24 are provided, each of greater axial length than the axial length of the paper rolls *a* and of sufficient diameter to fit within their hollow cores *b*. These spindles are of sufficient length to nearly span the distance between the side walls 13, 14 of the cabinet 10.

Fixed to the side walls 13, 14 of the upper storage portion 11 of the dispensing cabinet 10 by rivets 25 are a pair of double-flanged upper channel tracks 30. The tracks 30 are symmetrical to each other and are fixed facing each other on opposing side walls 13, 14. Each upper channel track 30 has a forward flange 31 and a rear flange 32. At the upper end 33 of the upper track 30 is a funneling flap 34 adjacent the forward flange 31 and extending toward the forward door 15 of the dispensing cabinet 10. An aperture 36 is spaced upward from the lower end 35 of the upper track 30 in the forward flange 31 a distance greater than the diameter of a spindle 24. The tracks 30 are separated by a sufficient distance to permit the spindles 24 to be slidably engaged therebetween; their flanges 31, 32 being separated by a sufficient distance to accommodate the diameter of the spindles 24.

Also provided is a pair of double-flanged lower channel tracks generally designated 40, of similar width as the upper channel tracks 30. The lower tracks 40 face each other and are pivotably fixed to the side walls 13, 14 by aligned horizontal pivot pins 41. The lower channel tracks 40 have an upper portion 42 in substantially upright position and a lower portion 43 joined thereto at a juncture 44 near the pivot pins 41. The lower portion 43 angles forward and downward from the juncture 44 toward the forward opening 20 of the dispensing cabinet 10. Each channel track 40 has a forward flange 45 and a rear flange 46. At the lower end 47 of the lower channel track 40 is a track closure 48 which substantially blocks the space between the forward flange 45 and the rear flange 46. Track openings 49 of greater length than the diameter of the spindles 24 are provided in the forward flanges 45 adjacent the lower end 47.

Adjacent the upper end 50 of the lower channel track 40 are rear stops 51 extending first rearward and then upward. The rearward length of the rear stop 51 is approximately one-half the diameter of the spindle 24. A forward stop 52 extends upward from the forward flange 45. Extending rearward from the upper end of the forward stop 52 are angle detent pins 53. The length of the forward stop 52 is sufficient to allow insertion of the angle detent pins 53 through the apertures 36 in the upper channel tracks 30. The end projection 54 of the rear flange 46 at the upper end 50 of the lower track 40 is positioned intermediate the flanges 31, 32 at the lower end 35 of the upper tracks 30, when the dispensing cabinet is assembled.

A manually operated lever 55, which is an extension of the track closure 48, joins the pair of lower channel tracks 40 at their lower ends 47 and extends downwardly out through the forward opening 20 of the dispensing cabinet 10. Attached to the rear wall 19 of the dispensing cabinet 10 at its foremost point which has curved forward under the cabinet 10 is attached a lever detaining clip 60 against which the lever abuts.

Figure 5:
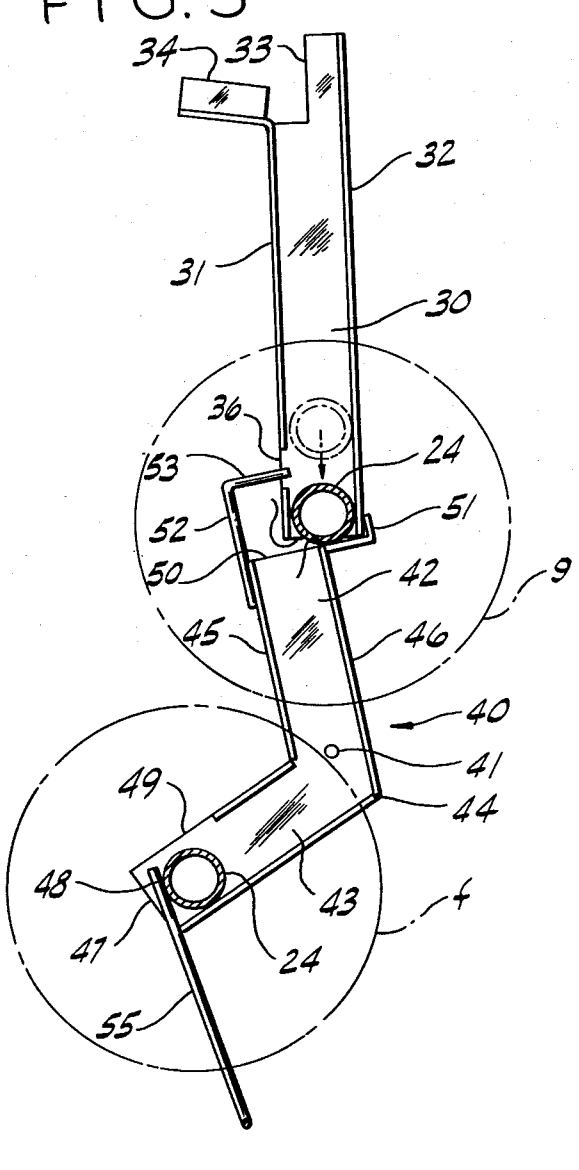
FIG. 5 is a schematic view of the present invention similar to FIGS. 3 and 4, demonstrating the descent of a second stored roll when the lower tracks are returned to a stop angle.
Figure 4:
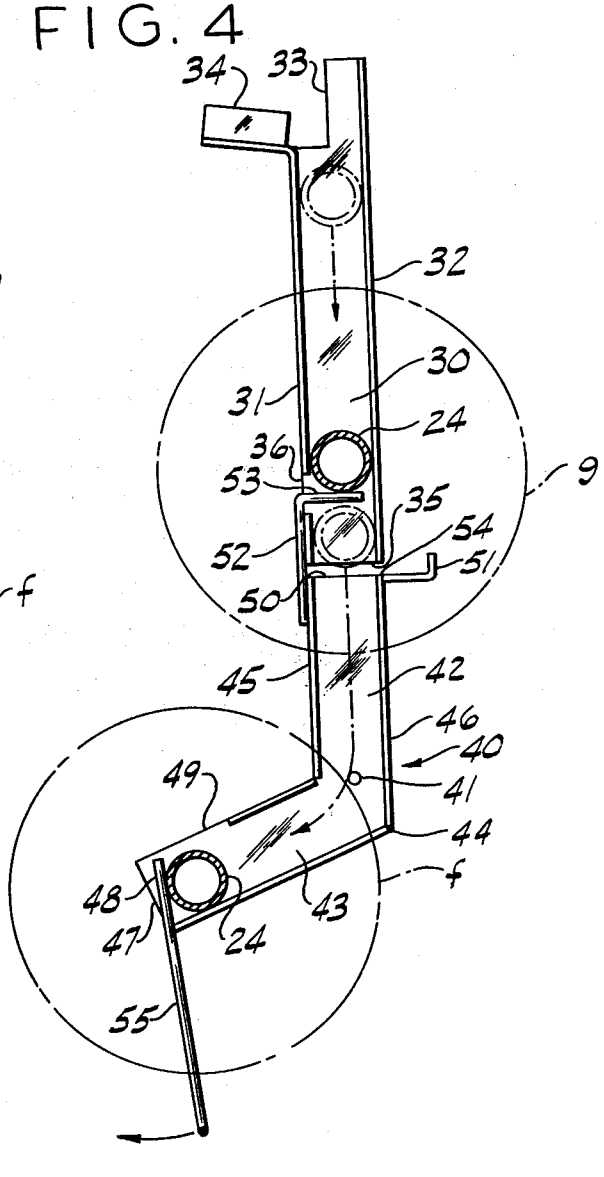
FIG. 4 is a schematic view similar to FIG. 3 demonstrating the movement of stored rolls upon removal of a spent roll and pivoting of the lower tracks to a feed angle.
Figure 3:
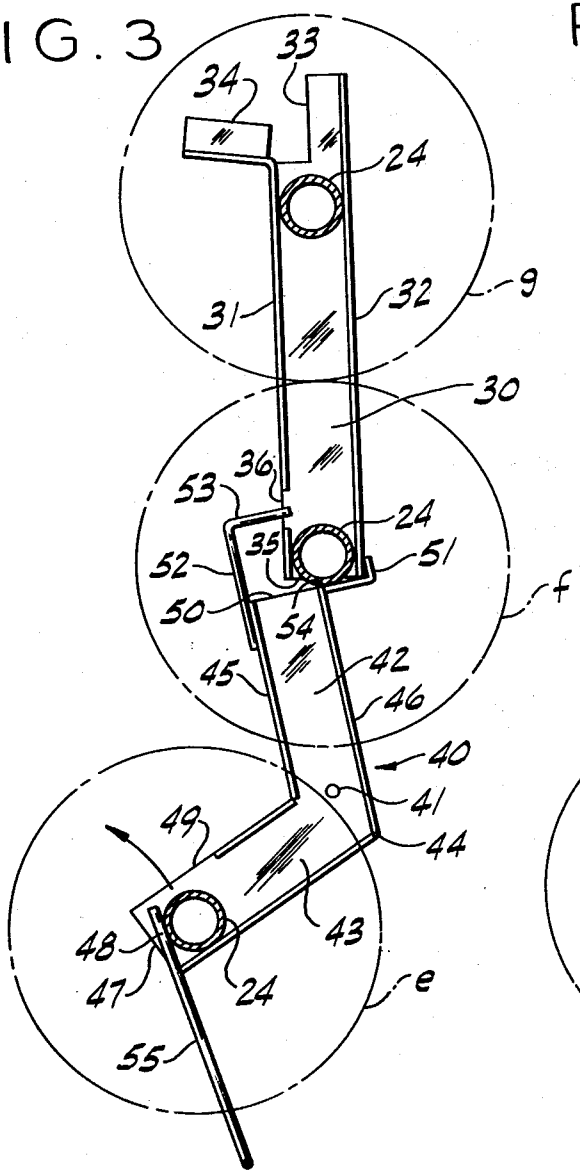
FIG. 3 is the first of a series of schematic views of the embodiment of FIGS. 1 and 2.

The use of the present invention may be most clearly understood by attention to the schematic drawings FIGS. 3–5. Except when a paper roll is to be changed, the lower tracks are positioned at an angle, hereinafter referred to as the stop angle, as shown in FIG. 3, in which its end projection 54 of its rear flange 46 is positioned intermediate the flanges 31, 32 of the upper tracks 30. FIG. 3 shows the dispensing cabinet 10 with three rolls of paper, specially designated *e, f, g*. The first roll *e* may be removed, after it is spent and only a hollow core *b* remains, by grasping the core *b* with the spindle 24 and pulling them upward through the track openings 49 of the lower tracks 40.

As is shown in FIG. 4, to feed a new fresh roll into dispensing position with the spindle 24 abutting the track closure 48 of the lower track 40 the lever 55 is manually pulled forward. This pivots the lower channel track 40 on the pivot pins 41 to an angle, hereinafter referred to as the feed angle, so as to be in alignment and registration with the upper channel track 30, permitting the second roll *f* to descend to dispensing position. Since the third roll *g* was supported by the second roll *f*, it too may descend, but its fall will be broken by the angle detent pins 53, which were inserted through the aperture 36 in the upper track 30 upon so pivoting the lower tracks 40 to the feed angle. Thus the third roll *g* is prevented from so descending as to jam against the second roll *f*.

In order to complete the required process, the lever arm 55 is then pushed rearward as in FIG. 5. The lower channel track pivots out of registration with the upper channel track 30 to the stop angle and the angle detent pins 53 are withdrawn from the apertures 36. Their withdrawal permits the third roll *g* to descend until it rests against the end projection 54 of the flange 46 of the lower track 40; thus being stored as roll *f* previously was. The process may be repeated to forward the third roll *g* to dispensing position.

Fresh rolls of paper *a* may be introduced into the dispensing cabinet 10 through the openable upper door portion 16 of the forward wall 15. The rolls a paper *a*, which must be on spindles 24, are conveniently placed in the upper channel tracks 30 with the aid of the funneling flaps 34.

Construction of the dispensing cabinet 10 may be most conveniently accomplished by cutting and forming the cabinet 10 from sheet metal. The channel tracks 30, 40 may be most suitably formed of sheet metal, cut and bent as required. The spindles 24 may be metal tubes cut to length.

Figure 6:
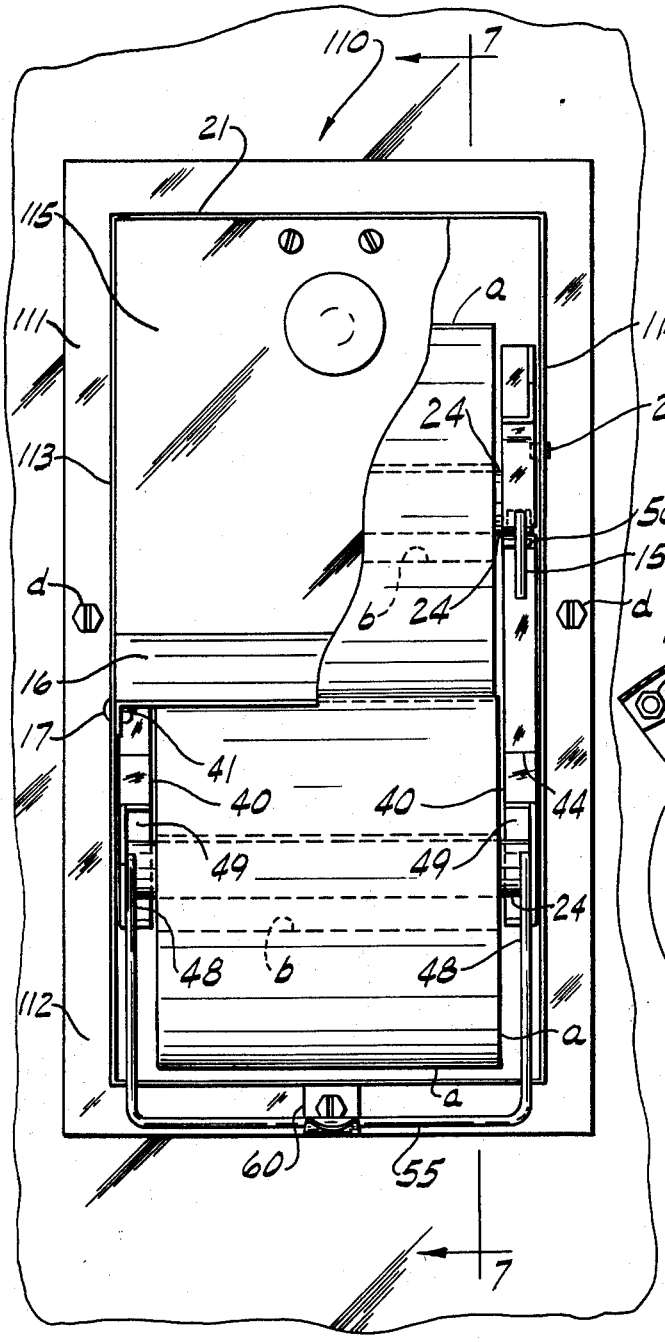
FIG. 6 is a front view of an alternative embodiment for storing only a single fresh roll of paper. The forward door is partially cut away to reveal the interior of the cabinet.
Figure 7:
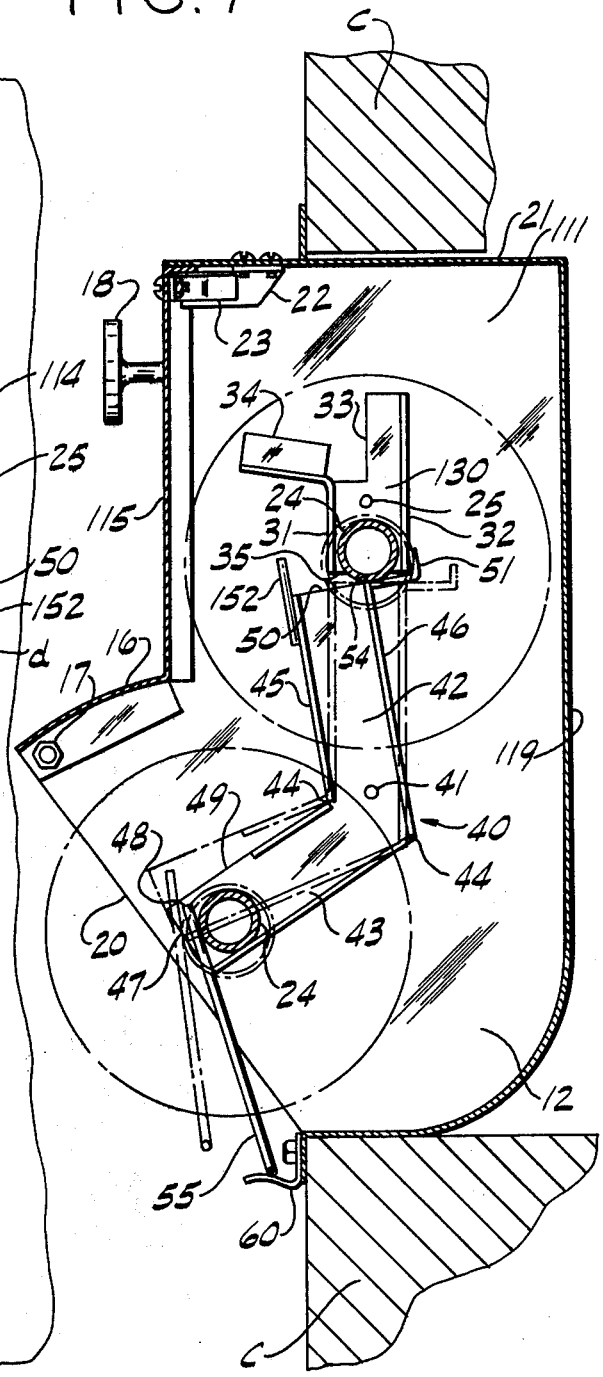
FIG. 7 is a cross-sectional view of the embodiment of FIG. 6, taken along line 7—7 of FIG. 6, showing the lower tracks at the stop angle in solid lines. Their feed angle is shown in phantom lines.

An alternative embodiment of the present invention which lacks the feature of storing more than one roll of paper in the upper channel track is shown in FIGS. 6 and 7. Corresponding parts bear identical numbers and description thereof is not repeated. The upper storage portion 111 with the forward door 115, sidewalls 113, 114, and rear wall 119 of the dispensing cabinet 110 need be only of sufficient height to accommodate a single roll *a* of paper. The upper channel track 130 need be only of sufficient length to accommodate the diameter of a single spindle 24. The lower channel track 40, is substantially the same, except that the forward stop 152 lacks an angle detent pin 53, since none is required. The upper channel track 130 likewise does not require an aperture 36 as did the prior embodiment. The remainder of the structure is substantially identical.

In using the second embodiment, a spent roll is similarly removed through the track opening 49 in the lower channel track 40. To forward a fresh roll the lever 55 is manually pulled outward; thus the upper channel track 130 and the lower channel track 40 are aligned in registration and the stored roll is fed, descending until it is in dispensing position, its spindle adjacent the track closure 48.

Various modifications of both described embodiments will be apparent to persons skilled in the art. Accordingly, the foregoing detailed description is not intended to limit the scope of the claims.

I claim:

1. A dispensing cabinet for dispensing a plurality of rolls of paper rolled on hollow cores, comprising a pair of facing double-flanged upper channel tracks mounted in the interior of such cabinet, a pair of facing double-flanged lower channel tracks mounted in the interior of such cabinet, and of a length greater than the diameter of such rolled paper, a plurality of spindles of such length and diameter as to fit slidably in said tracks and through such rolls of paper, means at the lower end of said lower tracks to establish a position at which such rolled paper may be dispensed, track openings adjacent to such position establishing means, whereby to permit removal of spindles and cores of spent rolls thereon, both said pairs of tracks leading downward in said cabinet, one pair being fixed, the other pair being pivotable from a feed angle from which the lower end of each upper channel track is adjacent to and in registration with the corresponding upper end of said lower channel track to a stop angle in which the upper end of one flange of each of the lower channel tracks is out of registration with the adjacent end of the upper channel track, each of the pair of lower tracks having an end projection presented, at said stop angle, intermediate the flanges of the corresponding upper tracks, whereby at such stop angle spindles bearing a roll of paper will be retained atop the end projections of the lower channels in a storage position, and means to move said pivotable pair of tracks together angularly from such stop angle to such feed angle, whereby after removal of a spent roll and its spindle, angular pivoting of said pivotable channel tracks will cause a second spindle and a roll thereon to descend from such storage position to such dispensing position.

2. A dispensing cabinet as defined in claim 1, in which the length of the upper pair of tracks is greater than the diameter of one of such rolls, whereby when the spindle of one such roll is at such storage position, another roll may be accommodated thereabove, together with an aperture in and adjacent to the lower end of each said upper channel track, spaced upward from said lower channel track a distance greater than the diameter of said spindles, and spindle detent means inserted through said apertures into said upper tracks when said pivotable tracks are at such feed angle and withdrawn therefrom when said pivotable tracks are at such stop angles, whereby pivoting to said feed angle and insertion of said detents stops the descent of such other roll until the pair of pivotable tracks is returned to such stop angle, and the accompanying withdrawal of said detents permits such other roll to descend to such storage position.

3. A dispensing cabinet as defined in claim 1, wherein the pivotable pair of tracks is the lower pair, and wherein the means to move said pivotable pair of tracks together angularly comprises a lever extending from and joining the lower ends thereof.

4. A dispensing cabinet as defined in claim 1, wherein said lower channel tracks are together angled downward and forward, whereby said rolled paper at dipensing position is presented forward.

5. A dispensing cabinet as defined in claim 1, wherein said lower channel tracks comprise an upper portion which is normally presented substantially vertical, and a lower portion extending continuously from a juncture with the upper portion and projecting angularly downward and forward therefrom, together with horizontal aligned pivot pin means substantially at said junctures to mount said lower channel tracks pivotably relative to the cabinet, and a manually operated lever extending from and joining the lower ends of said lower channel tracks.

6. A dispensing cabinet as defined in claim 1, wherein said means at the lower end of said lower tracks to establish a position at which such rolled paper may be dispensed comprises a track closure, blocking the lower end of each said track, whereby to retain a said spindle at such position.

7. Apparatus for dispensing paper rolled on hollow cores, comprising a plurality of spindles of such axial length and such diameter to fit through and extend outward from such hollow cores, a cabinet having fixed side walls spaced apart a distance to accommodate the axial length of such spindle, and having an openable forward wall, said cabinet having an upper storage portion of a greater depth measured horizontally than the diameter of such rolls of paper and a substantially deeper lower dispensing portion, said dispensing portion having a forward and downward opening for dispensing paper from such rolls, a pair of facing double-flanged upper channel tracks leading downward and fixedly mounted onto the inner surfaces of said side walls of said storage portion of said cabinet, a pair of facing double-flanged lower channel tracks leading downward along the inner surfaces of said side walls of said dispensing portion of said cabinet, said lower channel tracks being pivotable on pins fixed to said cabinet side walls from a feed angle in which the lower end of each upper channel track is adjacent to and in alignment with the corresponding upper end of said upper channel track to a stop angle in which the upper end of one flange of each of the lower channel tracks is positioned intermediate the flanges of the adjacent end of the upper track channels, whereby at such stop angle spindles engaged across said pair of upper channel tracks and bearing a roll of paper will be retained atop the ends of the lower channel in storage position, said lower channel tracks further being angled downward and forward along their portion below said pins, a track closure closing the lower end of said lower channel to retain a said spindle in dispensing position, whereby paper from said roll may be dispensed through said forward opening of said cabinet dispensing portion, said portions of said lower channel tracks below said pins each further having an opening in the upper flange adjacent to said closure whereby to permit removal of the spindle and the cores of spent rolls, stops so fixed on both upper ends of said channels of said lower channel tracks relative to said upper channel tracks to permit movement of said lower channel tracks only between such feed angle and such stop angle, a lever joining the lower ends of said lower channel tracks and extending outward through said forward opening of said cabinet lower portion, whereby manual movement of the lever pivots said lower track from such stop angle to such feed angle, and means to detain the lever with said lower tracks at such stop angle, whereby after removal of a spent core and its spindle, angular pivoting of said pair of lower channel tracks to such feed angle will cause second spindle and the roll thereon to descend from such storage position to such dispensing position.

8. The apparatus as defined in claim 7, in which the length of the upper pair of channel tracks is greater than the diameter of one of said rolls, whereby when the spindle of one such roll is at the storage position, another roll may be accommodated thereabove, together with an aperture in and adjacent to the lower end of each of said upper channel tracks spaced upward from said lower channel track a distance greater than the diameter of said spindle, and spindle detent means so fixed to each said lower channel track as to be inserted through said apertures into said upper tracks when said lower track is pivoted to such feed angle and to be withdrawn therefrom when said lower track is pivoted to such stop angle, whereby on pivoting to said feed angle the insertion of said detent means stops the descent of such other roll until the lower pair of tracks is returned to such stop angle, and the accompanying withdrawal of said detent means permits an additional roll to descend into said storage position.

* * * * *

UNITED STATES PATENT AND TRADEMARK OFFICE

CERTIFICATE OF CORRECTION

PATENT NO. : 4,108,389

DATED : August 22, 1978

INVENTOR(S) : Rolla J. Womack

It is certified that error appears in the above-identified patent and that said Letters Patent are hereby corrected as shown below:

Column 4, line 38, "a paper" should read "of paper".

Column 7, Claim 7, line 23, insert "a" after the word "cause".

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*